US006223838B1

(12) United States Patent
Dengel et al.

(10) Patent No.: US 6,223,838 B1
(45) Date of Patent: May 1, 2001

(54) AUGER SYSTEM

(75) Inventors: Nicholas J. Dengel; Steve McCormick, Jr., both of Dickinson, ND (US)

(73) Assignee: Northern Improvement Company, Bismarck, ND (US)

( * ) Notice: Subject to any disclaimer, the term of this patent is extended or adjusted under 35 U.S.C. 154(b) by 0 days.

(21) Appl. No.: 09/440,035

(22) Filed: Nov. 12, 1999

(51) Int. Cl.[7] ..... E21B 10/44; E21B 17/22

(52) U.S. Cl. ..... 175/57; 175/323; 175/394; 175/402

(58) Field of Search ..... 175/323, 394, 175/402, 406, 57; 299/41.1, 39.4; 404/90; 294/86.34

(56) References Cited

U.S. PATENT DOCUMENTS 1,484,352 * 2/1924 Izard ..... 175/394
3,095,051 * 6/1963 Robinsky et al. ..... 175/270
3,794,127 * 2/1974 Davis ..... 175/58
4,458,949 * 7/1984 Jury ..... 299/41
4,924,951 * 5/1990 Paulson ..... 175/57
5,522,646 * 6/1996 Friedman et al. ..... 299/39.3

* cited by examiner

*Primary Examiner*—Hoang Dang
(74) *Attorney, Agent, or Firm*—Michael S. Neustel

(57) ABSTRACT

An auger system for removing material from around an object without damaging the object. The inventive device includes a tubular auger attachable to a drive unit, and an insert member insertable within the upper opening of the valve casing. The tubular auger is comprised of a plurality of mill teeth attached to the lower portion of the tubular auger. The tubular auger includes an auger lumen that is positionable about the valve casing during cutting. The insert member is comprised of lower portion that is positionable within the casing lumen of the valve casing, and an outer portion that has an outer diameter approximately the same as the outer diameter of the valve casing for guiding the tubular auger and for preventing debris from entering the valve casing. The insert member preferably includes a handle for allowing insertion and removal from the valve casing.

17 Claims, 5 Drawing Sheets

AUGER SYSTEM

BACKGROUND OF THE INVENTION

1. Field of the Invention

The present invention relates generally to auger devices and more specifically it relates to an auger system for removing material from around an object without damaging the object.

Water valves and other objects are often times located along a street. Water valves have a tubular casing that extends upwardly from the valve exposing a fitting through the upper surface of the street. When a street is old and requires improvements, asphalt grinders are sometimes utilized to lower the street surface. To avoid damaging the valve within the street, many workers must utilize jackhammers, picks and shovels to remove asphalt, cement, gravel, dirt and other debris from about the tubular casing of the valve. After the debris is removed, the workers are able to lower the height of the tubular casing thereby allowing them to grind the surface of the street to the desired level. Hence, there is a need for a system that conveniently and easily removes the debris from about an object such as a tubular casing of a valve thereby eliminating the significant labor required.

2. Description of the Prior Art

Auger devices have been in use for years. Typically, an auger device comprises an elongated center member, a length of flighting attached about the center member, and a plurality of mill teeth at the lower portion of the center member.

Conventional auger devices do not allow for removing debris from around an object for allowing removal or adjustment of the object. Conventional auger devices are designed for removing a cylindrical volume of debris and are not designed for removing debris from about an object.

Examples of attempted solutions to removing debris from about objects include U.S. Pat. No. 4,458,949 to Jury; U.S. Pat. No. 4,924,951 to Paulson; U.S. Pat. No. 5,470,131 to Nolan et al.; U.S. Pat. No. 4,968,101 to Bossow; U.S. Pat. No. GB2134165A to James which are all illustrative of such prior art.

Jury (U.S. Pat. No. 4,458,949) discloses a manhole casting removing device. Jury specifically teaches a device mounted on a conventional road grader that has been modified to accommodate the device and is positioned over the manhole casting so that the existing pavement and cement may be cut from the road surface and the manhole casting for allowing adjustment of the manhole casing.

Paulson (U.S. Pat. No. 4,924,951) discloses a manhole cutter for cutting a circular groove of a fixed depth about a manhole. Paulson specifically teaches a cutter ring assembly with staggered cutters and clean-out slots that rotate about a central shaft of the cutter.

Nolan et al. (U.S. Pat. No. 5,470,131) discloses an apparatus for cutting circular slots in pavement about manhole castings. Nolan et al. specifically teaches a self-propelled core-cutting apparatus that is utilized to cut circular slots in pavement extending about manhole castings to permit the castings to be adjusted in height.

Bossow (U.S. Pat. No. 4,968,101) discloses a vertical asphalt and concrete miller. Bossow specifically teaches a drive unit that is mechanically connected to a rotary cutting head.

James (GB2134165A) discloses a device for removing bodies from road surfaces. James specifically teaches a burner adapted to apply direct heat onto the roadway to soften the roadway about the object and a member having a cutting edge for cutting around the object.

While these devices may be suitable for the particular purpose to which they address, they are not as suitable for removing material from around an object without damaging the object. Conventional auger devices are not designed to cut around an object within a street. In addition, manhole cutting devices are incapable of cutting around a valve casing without damaging the valve casing.

In these respects, the auger system according to the present invention substantially departs from the conventional concepts and designs of the prior art, and in so doing provides an apparatus primarily developed for the purpose of removing material from around an object without damaging the object.

SUMMARY OF THE INVENTION

In view of the foregoing disadvantages inherent in the known types of auger devices now present in the prior art, the present invention provides a new auger system construction wherein the same can be utilized for removing material from around an object without damaging the object.

The general purpose of the present invention, which will be described subsequently in greater detail, is to provide a new auger system that has many of the advantages of the auger devices mentioned heretofore and many novel features that result in a new auger system which is not anticipated, rendered obvious, suggested, or even implied by any of the prior art auger devices, either alone or in any combination thereof.

To attain this, the present invention generally comprises a tubular auger attachable to a drive unit, and an insert member insertable within the upper opening of the valve casing. The tubular auger is comprised of a plurality of mill teeth attached to the lower portion of the tubular auger. The tubular auger includes an auger lumen that is positionable about the valve casing during cutting. The insert member is comprised of lower portion that is positionable within the casing lumen of the valve casing, and an outer portion that has an outer diameter approximately the same as the outer diameter of the valve casing for guiding the tubular auger and for preventing debris from entering the valve casing. The insert member preferably includes a handle for allowing insertion and removal from the valve casing.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an auger system that will overcome the shortcomings of the prior art devices.

Another object is to provide an auger system that removes material from around an object without damaging the object.

An additional object is to provide an auger system that maintains the object in its normal position during and after cutting of the debris from about the object.

A further object is to provide an auger system that is attachable to a conventional tractor.

Another object is to provide an auger system that significantly reduces labor costs in lowing a valve casing.

An additional object is to provide an auger system that significantly reduces the time required to remove material from a valve casing.

Another object is to provide an auger system that reduces the amount of injuries to workers during removal of debris from about the valve casing.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
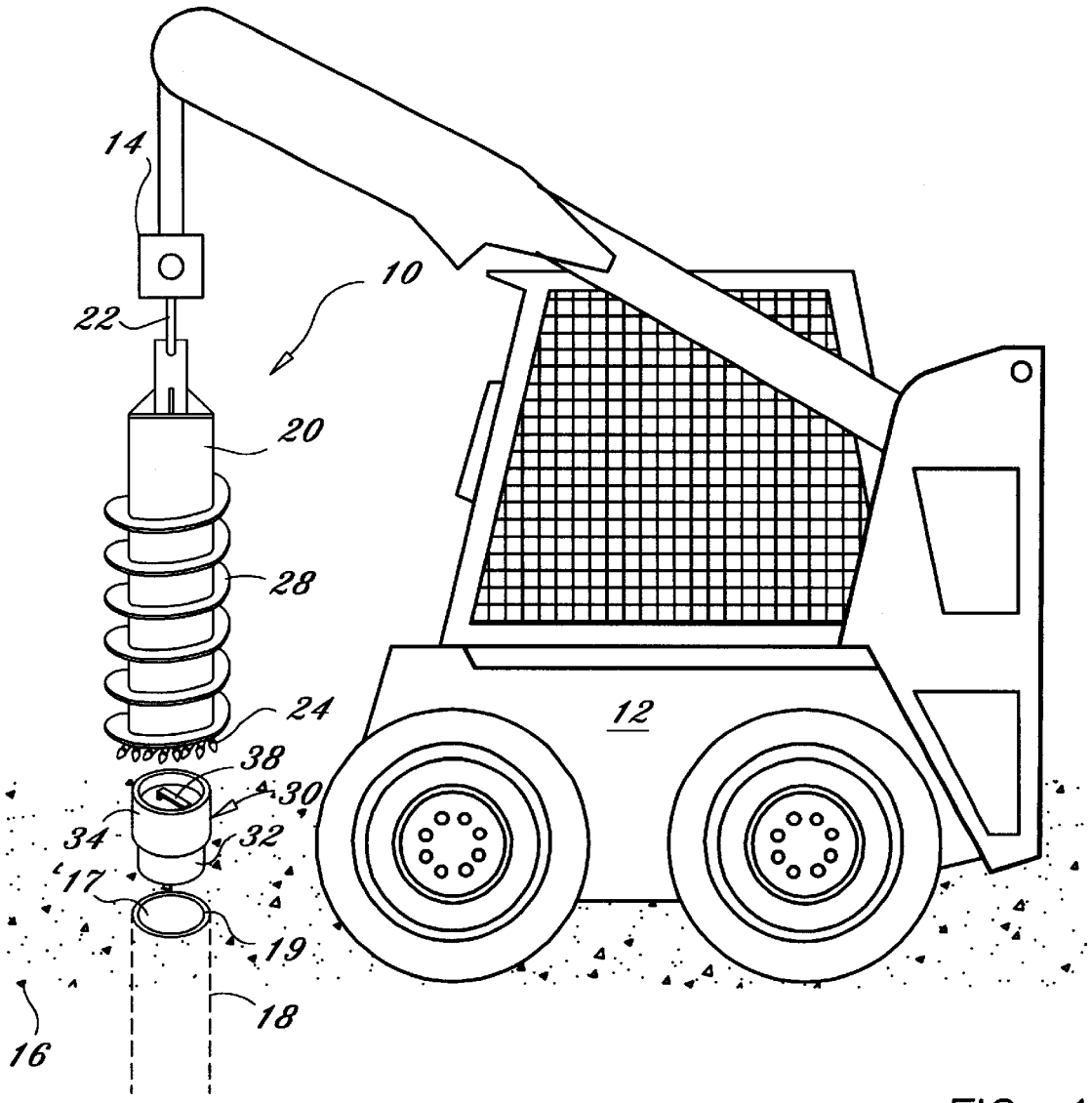
FIG. 1 is an exploded upper side view of the present invention attached to a loader of a tractor.

Turning now descriptively to the drawings, in which similar reference characters denote similar elements throughout the several view, FIGS. 1 through 5 illustrate an auger system 10, which comprises a tubular auger 20 attachable to a drive unit 14, and an insert member 30 insertable within the upper opening 19 of the valve casing 18. The tubular auger 20 is comprised of a plurality of mill teeth 24 attached to the lower portion 32 of the tubular auger 20. The tubular auger 20 includes an auger lumen 26 that is positionable about the valve casing 18 during cutting. The insert member 30 is comprised of lower portion 32 that is positionable within the casing lumen 17 of the valve casing 18, and an outer portion that has an outer diameter approximately the same as the outer diameter of the valve casing 18 for guiding the tubular auger 20 and for preventing debris from entering the valve casing 18. The insert member 30 preferably includes a handle 38 for allowing insertion and removal from the valve casing 18.

As shown in FIG. 1 of the drawings, a tractor 12 typically has a loader structure for supporting a bucket. A conventional drive unit 14 is pivotally attached to the loader structure of the tractor 12. The drive unit 14 may be operated by hydraulic power from the tractor 12, however various other power means may be utilized for the drive unit 14 and will not be discussed as they are well-known in the art.

As shown in FIG. 1 of the drawings, a valve has a vertical orientated valve casing 18 that extends through the surface of the ground 16 or street. The valve casing 18 has an upper opening 19 that exposes a casing lumen 17. A coupler member is positioned within the valve casing 18 for allowing opening and closing of the valve. The upper opening 19 of the valve casing 18 is typically covered by a cover member. When the valve needs to be closed or opened, the valve cover is removed thereby exposing the coupler member for opening or closing the valve. The valves, manholes, and similar structures are well-known in the art and will not be discussed any further.

Figure 2:
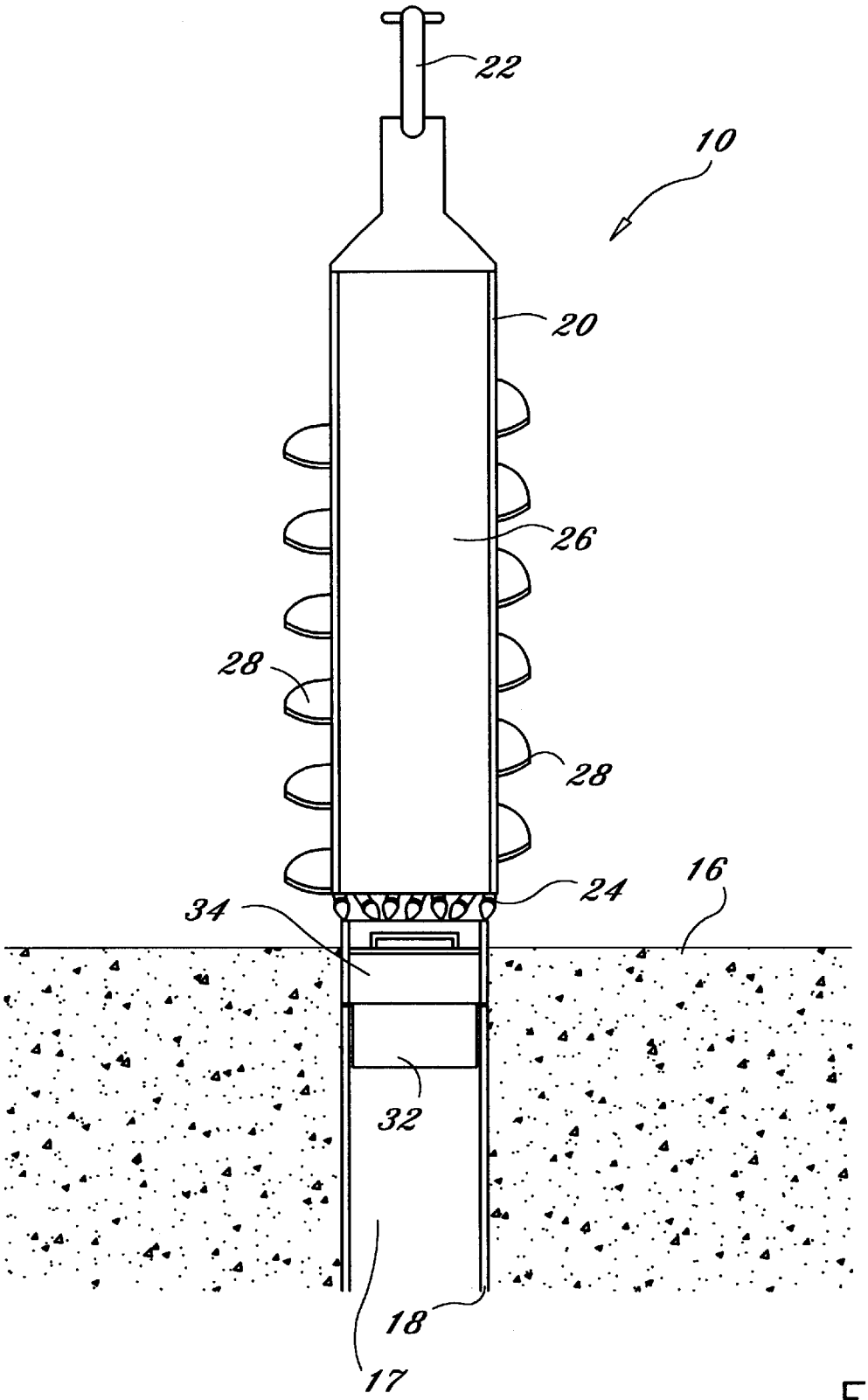
FIG. 2 is an exploded cutaway side view of the tubular auger above the insert member positioned within the valve casing.
Figure 3:
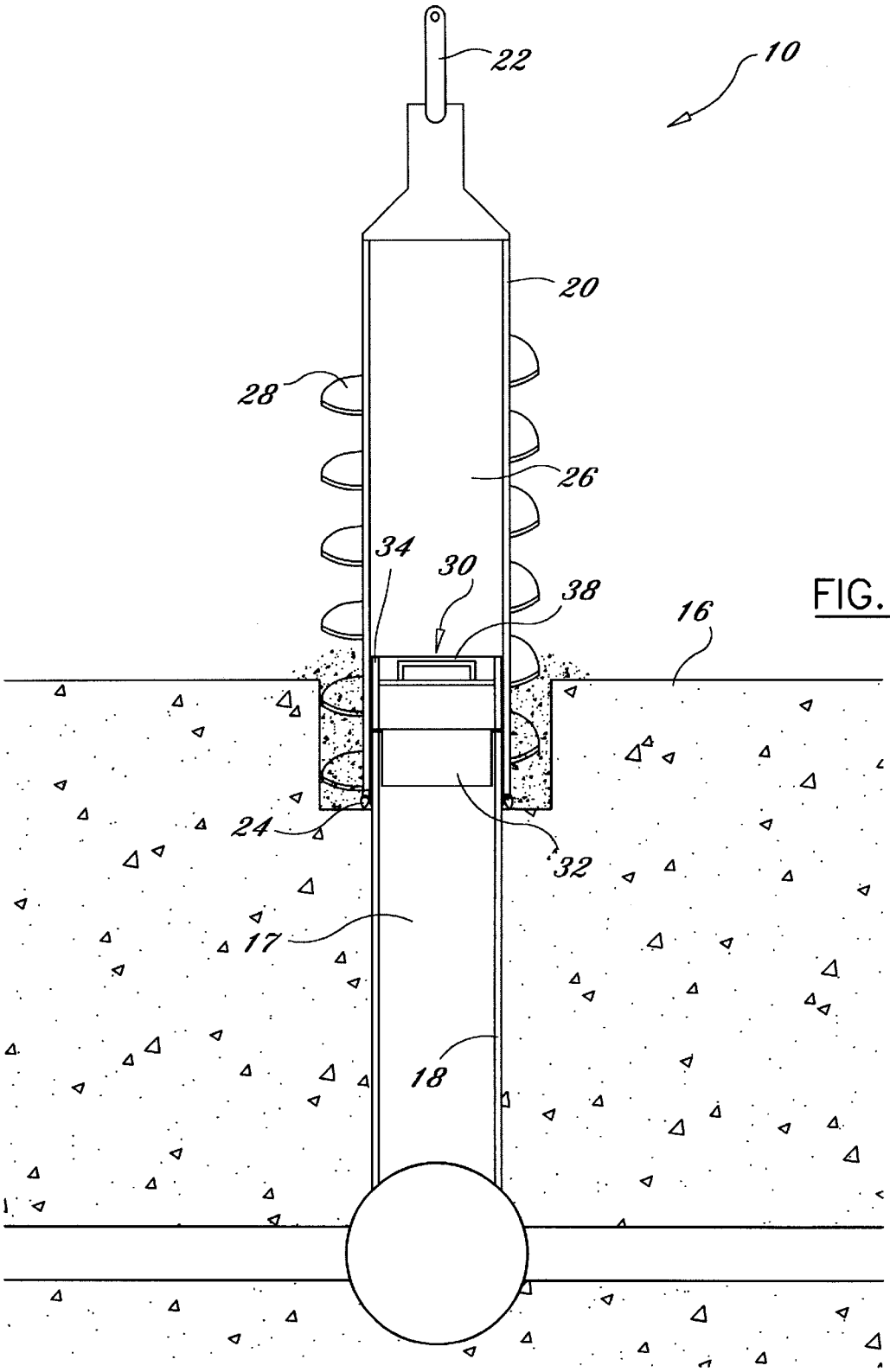
FIG. 3 is an cutaway side view of the tubular auger penetrating and removing the material from about the valve casing.

As shown in FIGS. 1 through 3 of the drawings, the tubular auger 20 includes a drive shaft 22 that is attachable to the drive unit 14. The tubular auger 20 is comprised of a tubular structure as shown in FIGS. 1 through 5 of the drawings. The tubular auger 20 is also an elongated structure and can have any length as desired for allowing cutting to various depths. The tubular auger 20 is comprised of any well-known material as can be appreciated.

The tubular auger 20 including a lower opening thereby exposing the auger lumen 26 within the tubular auger 20. The lower opening and the auger lumen 26 are large enough to rotatably fit about an object such as a valve casing 18. The tubular auger 20 further includes a plurality of mill teeth 24 attached about the lower opening for cutting the ground 16 or other material such as asphalt, concrete, rock, sand, gravel or other debris. The mill teeth 24 may be comprised of any well-known material for mill teeth 24 and should not be limited by this disclosure. The mill teeth 24 preferably extend from the lower end of the tubular auger 20 at various angles.

Figure 4:
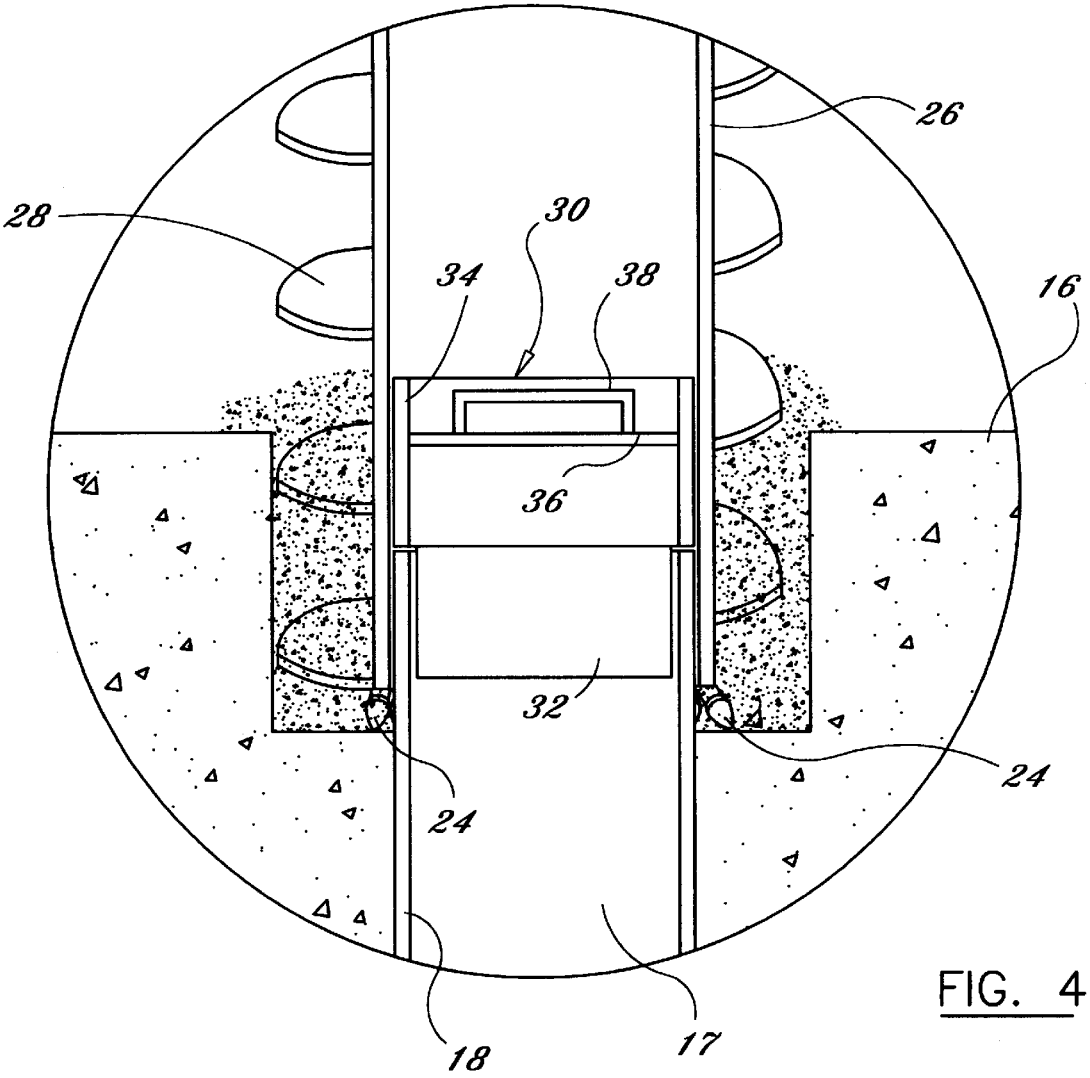
FIG. 4 is a magnified view from FIG. 3 showing the tubular auger about the valve casing.
Figure 5:
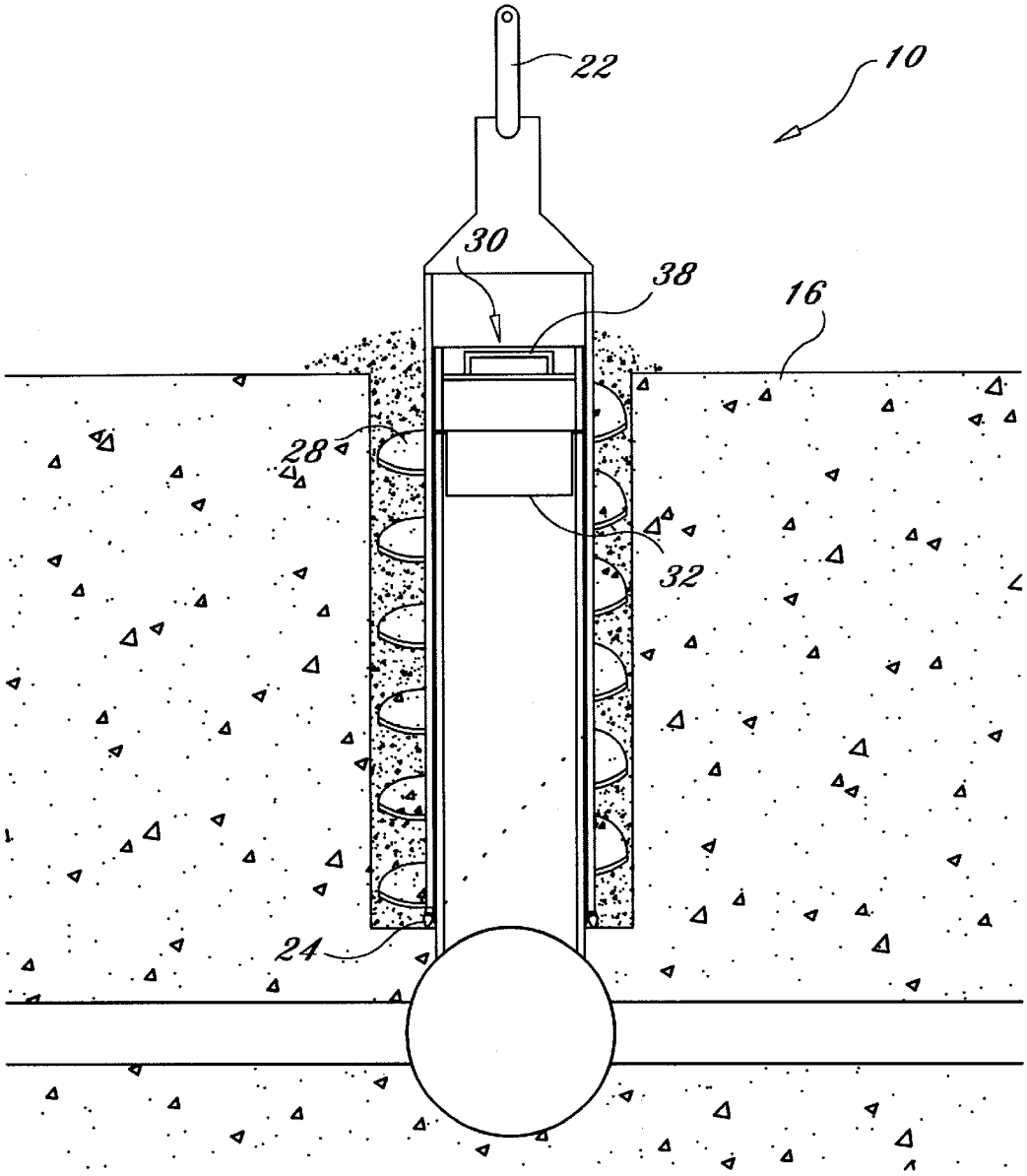
FIG. 5 is a cutaway side view of the tubular auger fully extended about the valve casing.

As best shown in FIG. 1 of the drawings, a length of flighting 28 is attached about the outer surface of the tubular auger 20 for lifting the cut debris from about the object being cut about as shown in FIGS. 3 through 5 of the drawings. The flighting 28 may have various pitches depending upon the type of material being cut and at what rotational speeds.

As best shown in FIG. 1 of the drawings, the insert member 30 is tubular shaped. The insert member 30 includes a lower portion 32 and an upper portion 34 as best shown in FIG. 2 of the drawings. The outer diameter of the lower portion 32 is sized to snugly fit within the casing lumen 17 of the upper opening 19 of the valve casing 18 as shown in FIG. 2 of the drawings. The upper portion 34 of the insert member 30 has a greater outer diameter than the lower portion 32 as shown in FIG. 4 of the drawings. The outer diameter of the upper portion 34 is preferably equal to or greater than the outer diameter of the valve casing 18 for guiding the tubular auger 20 about the valve casing 18.

As shown in FIG. 4 of the drawings, a cap 36 is attached to the insert member 30 for preventing debris from entering the insert member 30 and then into the valve casing 18. A handle 38 is preferably attached to the insert member 30 for allowing easy insertion and removal of the insert member 30 into the valve casing 18.

In use, the user removes the valve cover from the upper opening 19 of the valve casing 18 thereby exposing the upper opening 19. The user then inserts the lower portion 32 of the insert member 30 into the casing lumen 17 of the valve casing 18 as best shown in FIG. 2 of the drawings. The user pushes the insert member 30 down until the upper portion 34 of the insert member 30 is snugly against the upper edge of the valve casing 18 as shown in FIG. 4 of the drawings. The user then operates the tractor 12 so as to position the tubular auger 20 directly above the insert member 30 and the valve casing 18 as shown in FIGS. 1 and 2 of the drawings. The user then lowers the tubular auger 20 about the insert member 30 until the mill teeth 24 engage the surface of the ground 16. The user then operates the drive unit 14 for rotating the tubular auger 20 and applies a slight downward force upon the tubular auger 20. The mill teeth 24 remove the debris such as asphalt, concrete, sand and other debris from about the valve casing 18 as shown in FIG. 3 of the drawings. As the tubular auger 20 rotates about the valve casing 18 and the insert member 30, the flighting 28 about the tubular auger 20 elevates the cut debris out of the slot onto the upper surface of the ground 16 for removal. The user continues lowering the tubular auger 20 until the desired depth has been reached as shown in FIG. 5 of the drawings. The user then operates the tubular auger 20 for removing as much loose debris from about the valve casing 18 as possible. The user then removes the tubular auger 20 from about the valve casing 18 and then removes the insert member 30 from the valve casing 18. The user then utilizes conventional tools for rotating and lowering the valve casing 18 to the desired level thereby allowing milling of the street surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An auger system, comprising:

a tubular auger having a lower opening and lumen attachable to a drive means;

a guide member positionable within an upper opening of a valve casing, wherein said guide member is positionable within said lumen of said tubular auger, and wherein said guide member is enclosed for preventing debris from entering the valve casing.

2. The auger system of claim 1, wherein said guide member includes a handle.

3. The auger system of claim 1, wherein said guide member is comprised of a lower portion and an upper portion.

4. The auger system of claim 3, wherein an outer diameter of said lower portion is smaller than the upper opening of the valve casing.

5. The auger system of claim 3, wherein an outer diameter of said upper portion is at least the outer diameter of the valve casing.

6. The auger system of claim 1, wherein said tubular auger is comprised of:

a tubular member having a drive shaft extending from an upper end of said tubular member for engaging the drive means;

a length of flighting attached to an exterior surface of the tubular member; and a plurality of teeth attached to said lower opening of said tubular member.

7. The auger system of claim 6, wherein a lumen of said tubular member is greater in diameter than an outer diameter of an outer portion of said guide member.

8. The auger system of claim 6, wherein said guide member is comprised of a lower portion and an upper portion.

9. The auger system of claim 8, wherein an outer diameter of said lower portion is smaller than the upper opening of the valve casing.

10. The auger system of claim 8, wherein an outer diameter of said upper portion is at least the outer diameter of the valve casing.

11. The auger system of claim 10, wherein said guide member includes a handle.

12. An auger system, comprising:

a tubular auger having a lower opening and lumen attachable to a drive means; and a guide member having a lower portion and an upper portion, wherein said lower portion of said guide member is positionable within an upper opening of a valve casing and wherein said upper portion of said guide member has an outer diameter at least the size of an outer diameter of the valve casing.

13. The auger system of claim 12, wherein said guide member is enclosed for preventing debris from entering the valve casing.

14. The auger system of claim 12, wherein said guide member includes a handle.

15. The auger system of claim 12, wherein said tubular auger is comprised of:

a tubular member having a drive shaft extending from an upper end of said tubular member for engaging the drive means;

a length of flighting attached to an exterior surface of the tubular member; and a plurality of teeth attached to said lower opening of said tubular member.

16. The auger system of claim 15, wherein a lumen of said tubular member is greater in diameter than said outer diameter of said outer portion of said guide member.

17. A method of utilizing an auger system have a tubular auger having a lower opening and lumen attachable to a drive means, and a guide member positionable within an upper opening of a valve casing wherein at least one portion of said guide member has an outer diameter at least the size of an outer diameter of the valve casing, comprising the steps of:

(a) positioning said guide member within the upper opening of the valve casing;

(b) positioning said tubular auger about said guide member; and (c) rotating said tubular auger thereby removing material surrounding the valve casing.

* * * * *